US008433071B2

(12) United States Patent
Latzel

(10) Patent No.: US 8,433,071 B2
(45) Date of Patent: Apr. 30, 2013

(54) IN SITU MEASUREMENT

(75) Inventor: Matthias Latzel, Eggolsheim (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1436 days.

(21) Appl. No.: 12/079,141

(22) Filed: Mar. 25, 2008

(65) Prior Publication Data

US 2008/0240476 A1 Oct. 2, 2008

(30) Foreign Application Priority Data

Mar. 30, 2007 (DE) ..... 10 2007 015 456

(51) Int. Cl.
*H04R 24/00* (2006.01)

(52) U.S. Cl.
USPC ..... 381/60; 381/324

(58) Field of Classification Search ..... 381/60, 381/312–331
See application file for complete search history.

(56) References Cited

U.S. PATENT DOCUMENTS

| | | | | |
|---|---|---|---|---|
| 4,827,525 | A * | 5/1989 | Hotvet et al. | 381/60 |
| 5,645,074 | A * | 7/1997 | Shennib et al. | 600/559 |
| 6,658,122 | B1 * | 12/2003 | Westermann et al. | 381/312 |
| 6,940,988 | B1 * | 9/2005 | Shennib et al. | 381/322 |
| 7,010,135 | B2 * | 3/2006 | Von Buol | 381/318 |
| 7,025,061 | B2 * | 4/2006 | Haussmann | 128/864 |
| 7,082,205 | B1 * | 7/2006 | Westermann | 381/312 |
| 7,185,734 | B2 * | 3/2007 | Widmer et al. | 181/135 |
| 7,240,765 | B2 * | 7/2007 | Berg et al. | 181/135 |
| 7,319,399 | B2 * | 1/2008 | Berg | 340/573.1 |
| 7,369,670 | B2 * | 5/2008 | Haussmann | 381/322 |
| 7,401,680 | B2 * | 7/2008 | Kurth | 181/135 |
| 7,450,730 | B2 * | 11/2008 | Berg et al. | 381/312 |
| 7,512,243 | B2 * | 3/2009 | Haussmann | 381/72 |
| 7,515,720 | B2 * | 4/2009 | Schwob | 381/60 |
| 7,536,022 | B2 * | 5/2009 | Von Buol | 381/318 |
| 7,688,983 | B2 * | 3/2010 | Voix et al. | 381/60 |
| 7,715,571 | B2 * | 5/2010 | Boretzki et al. | 381/60 |
| 7,813,520 | B2 * | 10/2010 | Von Dach et al. | 381/372 |
| 7,885,416 | B2 * | 2/2011 | Chalupper et al. | 381/60 |
| 8,059,847 | B2 * | 11/2011 | Nordahn | 381/328 |
| 8,254,587 | B2 * | 8/2012 | Voix et al. | 381/56 |
| 2006/0013421 | A1 * | 1/2006 | Kasztelan | 381/312 |
| 2006/0042866 | A1 * | 3/2006 | Widmer et al. | 181/135 |
| 2006/0045297 | A1 * | 3/2006 | Haussmann | 381/322 |
| 2006/0045299 | A1 * | 3/2006 | Haussmann | 381/328 |
| 2007/0009107 | A1 * | 1/2007 | Lange | 381/60 |
| 2007/0076909 | A1 * | 4/2007 | Roeck et al. | 381/312 |
| 2007/0160243 | A1 * | 7/2007 | Dijkstra et al. | 381/317 |
| 2007/0217636 | A1 * | 9/2007 | Schwob | 381/312 |
| 2008/0137873 | A1 * | 6/2008 | Goldstein | 381/57 |
| 2008/0137892 | A1 * | 6/2008 | Shennib et al. | 381/328 |
| 2008/0240476 | A1 * | 10/2008 | Latzel | 381/312 |
| 2008/0260192 | A1 * | 10/2008 | Yanz et al. | 381/330 |
| 2009/0129619 | A1 * | 5/2009 | Nordahn | 381/328 |
| 2009/0220099 | A1 * | 9/2009 | Voix et al. | 381/59 |
| 2010/0111316 | A1 * | 5/2010 | Voix et al. | 381/60 |
| 2010/0135502 | A1 * | 6/2010 | Keady et al. | 381/58 |
| 2010/0246869 | A1 * | 9/2010 | Zhang et al. | 381/320 |
| 2012/0177210 | A1 * | 7/2012 | Goldstein et al. | 381/58 |

* cited by examiner

*Primary Examiner* — David S. Warren

(57) ABSTRACT

In-situ measurement comprises two consecutive measurements (open ear gain and in-situ gain), from which a result is formed by forming a difference. For the two measurements, it is important that the in-situ tube is positioned in the same place in the auditory canal. Otherwise there are different level and phase ratios, such that the result obtained from the formation of a difference is not meaningful. Thus, the in-situ tube is permanently connected to the ear plug, as a result of which the positioning of the in-situ tube remains the same for both measurements.

2 Claims, 1 Drawing Sheet

IN SITU MEASUREMENT

CROSS REFERENCE TO RELATED APPLICATIONS

This application claims priority of German application No. 10 2007 015 456.0 DE filed Mar. 30, 2007, which is incorporated by reference herein in its entirety.

FIELD OF INVENTION

The present invention relates to in-situ measurement.

SUMMARY OF INVENTION

In-situ measurement is generally a very complex measurement which is mostly also prone to error and hence produces results which are difficult or even impossible to interpret. This is particularly the case for hearing aids which are open-fitting. The most likely error in in-situ measurement is the use of 2 consecutive measurements (open ear gain and in-situ gain) which are related to one another in order to form a result. The difference between the two measurements gives the insertion gain as the actual measured variable of the in-situ measurement. However, since it is very difficult to ensure that the said two measurements take place under the same conditions, thereby permitting mutual referencing (formation of a difference), the overall result leads to erroneous results. For both the said measurements it is in fact necessary for the in-situ tube to be positioned in the same place in the auditory canal. Otherwise there are different level and phase ratios which prevent the formation of a difference.

As already described in section 1, the in-situ tube is positioned as far as possible in the same place during the OEG and in-situ measurement. However, it (very) frequently happens that when the otoplastic (or the hearing aid, in the case of ITE aids) is inserted the position of the in-situ tube is changed, or the in-situ tube is compressed. As a result, both level and phase ratios change, especially at high frequencies. In hearing aids with open standard ear plugs, the scenario just described occurs even more frequently, since the soft material of the standard ear plugs used, consisting of sound tube and tip (a plug that can be plugged into the sound tube), makes it (almost) impossible to position the in-situ tube identically when performing the OEG and in-situ gain measurement.

DETAILED DESCRIPTION OF INVENTION

Figure 1:
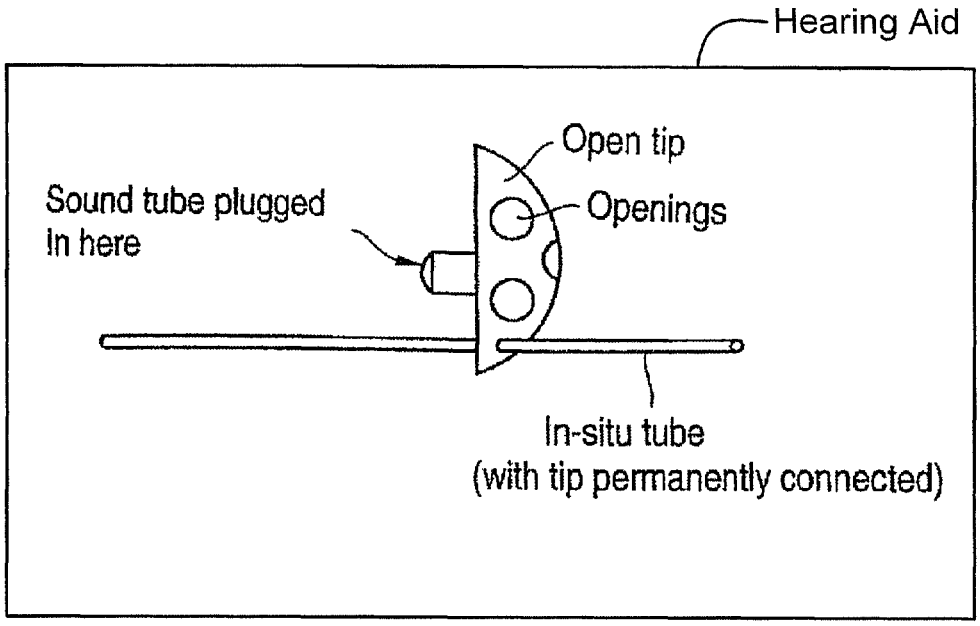
FIG. 1 illustrates a hearing aid including an in-situ tube with tip permanently connected.
Figure 2:
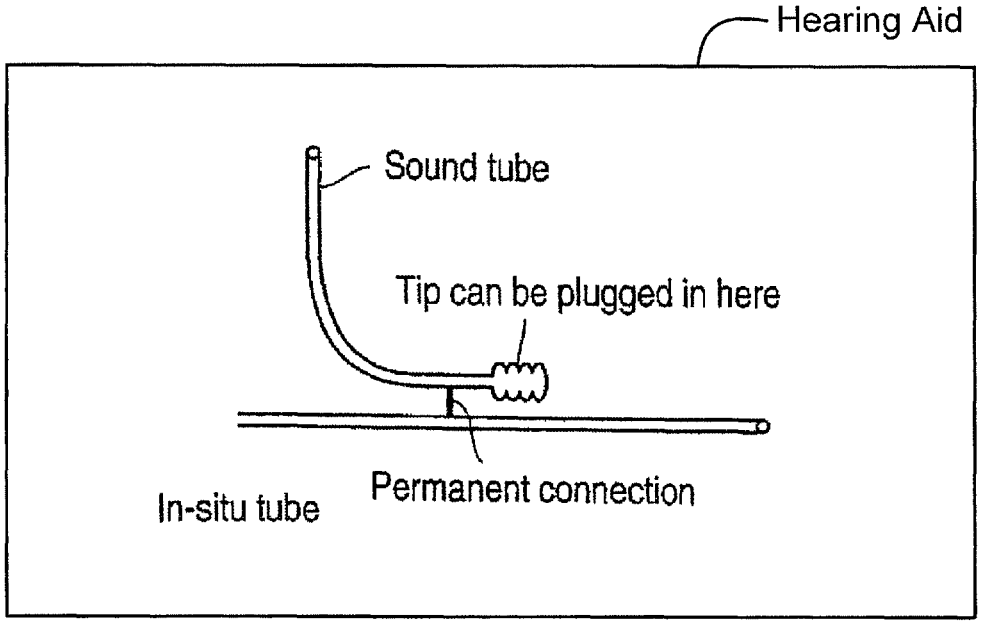
FIG. 2 illustrates a hearing aid including an in-situ tube permanently connected to a sound tube.

The sound tube mentioned under section 2 or the tip that can be plugged onto the sound tube is permanently connected to an in-situ tube according to the invention (see FIGS. 1 and 2 in the drawing), so that the exact identical positioning of the in-situ tube is ensured during OEG and in-situ gain measurement. The in-situ tube is thus permanently integrated into the standard ear plug (sound tube and tip). Therefore there is no need to insert the standard ear plug after the OEG measurement to perform the in-situ measurement.

With the invention, the OEG measurement is carried out using the standard ear plug. As a result the position of the in-situ tube for the subsequent in-situ measurement cannot be further changed, which was previously possible and even probable by inserting the standard ear plug after the OEG measurement. Since the tip is as "open" as possible, in the case of a tip (see FIG. 2) a measurement of the OEG is likewise involved, although the tip—together with the sound tube—is already in the auditory canal when the in-situ measurement is performed. If in fact comparative OEG measurements are performed, in which the ear is first of all completely open, and in the comparative measurement is closed by an "open tip", the same result is achieved. Thanks to the inventive action the OEG measurement can thus be measured with the standard ear plug situated in the ear (expanded by the permanently connected in-situ tube). All that is then necessary is to switch the hearing aid on and the in-situ gain can take place with the in-situ tube in exactly the same position. This allows a difference between the two measurements to be formed.

The tube calibration which is customary and necessary for in-situ measurements could be performed as previously with the in-situ tube integrated into the standard ear plug.

After the in-situ measurement has been performed the in-situ tube can be cut off from the rest of the standard ear plug, so that it does not impede the hearing aid wearer in everyday life.

In-situ measurement on hearing aid fittings can be performed more precisely and simply using the invention in the case of an open standard ear plug. The results are "more accurate" thanks to this procedure, since having identical level and phrase ratios makes the formation of a difference more meaningful.

The invention claimed is:

1. A method of in-situ measurement, comprising:

connecting an in-situ tube to an ear plug of a hearing aid, the ear plug comprising a sound tube and a tip;

positioning the ear plug at a fixed location within an auditory canal of a wearer of the hearing aid;

performing an open ear gain measurement using the in-situ tube positioned at the fixed location within the auditory canal; and performing an in-situ gain measurement using the in-situ tube positioned at the fixed location within the auditory canal.

2. A hearing aid, comprising:

an open ear plug comprising a sound tube and a tip, said ear plug configured to be positioned at a fixed location within an auditory canal of a wearer of the hearing aid; and an in-situ tube connected to the ear plug such that the in-situ tube is positioned at the fixed location during an open ear gain measurement and during an in-situ gain measurement conducted subsequent to the open ear gain measurement.

* * * * *